United States Patent [19]

Schade et al.

[11] Patent Number: 4,541,849

[45] Date of Patent: Sep. 17, 1985

[54] COLLECTOR ELECTRODE ASSEMBLY FOR TUBULAR ELECTROSTATIC PRECIPITATOR

[75] Inventors: Horst J. Schade, Frankfurt am Main; Rolf Gelhaar, Weilrod; Wolfgang Hartmann, Frankfurt am Main, all of Fed. Rep. of Germany

[73] Assignee: Metallgesellschaft Aktiengesellschaft, Frankfurt, Fed. Rep. of Germany

[21] Appl. No.: 572,585

[22] Filed: Jan. 20, 1984

[30] Foreign Application Priority Data

Jan. 28, 1983 [DE] Fed. Rep. of Germany ..... 3302851

[51] Int. Cl.[4] ..... B03C 3/49

[52] U.S. Cl. ..... 55/146; 55/154; 55/DIG. 38

[58] Field of Search ..... 55/146, 154, 155, 156, 55/DIG. 38, 435

[56] References Cited

U.S. PATENT DOCUMENTS 3,248,857 5/1966 Weindel et al. ..... 55/DIG. 38
4,173,690 11/1979 Geissner et al. ..... 55/146

FOREIGN PATENT DOCUMENTS 660175 5/1938 Fed. Rep. of Germany .... 55/DIG. 38
2134576 10/1975 Fed. Rep. of Germany .
2130074 2/1977 Fed. Rep. of Germany .
2641114 5/1981 Fed. Rep. of Germany .

*Primary Examiner*—David L. Lacey
*Attorney, Agent, or Firm*—Karl F. Ross; Herbert Dubno

[57] ABSTRACT

This invention relates to the part of a tubular electrostatic precipitator for a vertical gas flow, comprising a bank of circular cylindrical collecting electrodes of plastic material, at least one upper tube sheet, at least one lower tube sheet, and a cylindrical housing. The housing consists of a steel shell, which is provided with an acid-resisting coating at least on its inside surface, the tube sheets consist of plastic meterial, the circular cylindrical collecting electrodes are fixed by welding in the upper tube sheet, and the entire free space which is available between the tube sheets outside the collecting electrodes is filled with foamed plastic material as far as to the inside surface of the housing.

3 Claims, 2 Drawing Figures

COLLECTOR ELECTRODE ASSEMBLY FOR TUBULAR ELECTROSTATIC PRECIPITATOR

FIELD OF THE INVENTION

This invention relates to a collector electrode assembly or middle part of a tubular electrostatic precipitator for a vertical gas flow, comprising a bank of circular cylindrical collecting electrodes of plastic material, at least one lower tube sheet and a cylindrical housing.

BACKGROUND OF THE INVENTION

A tubular electrostatic precipitator is disclosed, inter alia, in German Pat. No. 21 34 576 wherein the housing of the middle part consists of plastic material, the tube sheets are made of metal which is coated with plastic material, and the cylindrical collecting tubes are suspended from the upper tube sheet and are sealed therein by means of fixing and sealing rings.

While the plastic housing of the middle part does not involve problems regarding corrosion, it leaves much to be desired as regards its mechanical properties.

For instance, in the manufacturing of relatively large housings the required dimensional accuracy involves a high expenditure. Besides, a separate outer supporting system of steel is always required because unless the plastic wall has an economically unreasonable thickness it will not have the strength required to support the bank of tubes and the top part of the electrostatic precipitator. Moreover, plastic material must be expected to gradually deform under load so that the distance between the corona electrodes and the collecting electrodes may be slightly changed and such change adversely affects the operation of the electrostatic precipitator.

Because the collecting tubes are supported by the upper tube sheet, the latter must be sufficiently rigid. For this reason at least the upper tube sheet had to be made of steel and protected from corrosion by a coating of plastic material. Coatings of plastic material can be provided in a relatively easy manner on objects which have a simple shape. But a tube sheet is formed with bores for receiving the collecting tubes and may be provided with reinforcing ribs joined by welding so that the application of an effective coating of plastic material to such a tube sheet involves substantial difficulties.

Besides, damage to the protective coating in transit and during the erection of the precipitator cannot be precluded. Moreover, adapting operations must often be performed on the site and may involve a removal of part of the coating. For this reason, additional coating material must be applied on the site but even this will not ensure an absolutely reliable protection against corrosion. As a result, corrosion may take place which cannot be detected on the surface but in the course of time may result in a failure of the entire plant.

The self-sealing mounting of the collecting tubes in the upper tube sheet does not reliably prevent an uncontrolled ingress of acid-containing gases into the space between the collecting tubes, where such gases may cause various defects.

It has been attempted to avoid some of these disadvantages by the use of the electrostatic precipitators disclosed in German patent specification No. 21 30 074 and 26 41 114 (see also U.S. Pat. No. 4,155,792). In said precipitators, the collecting electrodes define flow passages which are hexagonal in cross section.

While the cross-section of the housing is utilized in an improved manner in this case, the collecting capacity is adversely affected because the distance between the corona electrode and the collecting electrode is not uniform around the periphery and the operating voltage must be selected in dependence on the smallest distance. For this reason only six narrow strip-shaped areas can be optimally adjusted to this distance in a hexagonal collecting tube and a lower efficiency is obtained in the remaining areas.

These electrostatic precipitators also give rise to problems regarding the uniform wetting and the grounding. For instance, in accordance with German patent specification No. 21 30 074 special measures must be taken because the "outside" surface of the collecting electrode is not available for grounding.

Finally, hexagonal tubes or plate strips which define hexagonal passages (in accordance with German patent specification No. 26 41 114) are much more expensive than collecting electrodes consisting of standardized, circularly cylindrical plastic tubes and the assembling of such hexagonal tubes or of such plate strips is also more difficult and more expensive.

OBJECTS OF THE INVENTION

It is the principal object of the present invention to provide an improved collector-tube assembly for a tube-type or tubular electrostatic precipitator for vertical gas flow whereby the disadvantages of earlier systems are obviated.

A more specific object is to provide an improved middle part for a tubular electrostatic precipitator which eliminates the need for expensive and complex hexagonal flow tubes but yet affords a high degree of dimensional stability and eliminates at least some of the problems with prior art electrostatic precipitators enumerated above.

SUMMARY OF THE INVENTION

We have discovered, quite surprisingly, that the disadvantages of the earlier systems can be obviated by enclosing synthetic resin or plastic collecting-electrode tubes welded to the respective tube sheets, in a body of synthetic resin foam which completely fills the space between a plastic-lined steel shell and the tubes surrounded thereby.

This object is accomplished in that in a tubular electrostatic precipitator of the kind described first hereinbefore the cylindrical housing consists of a steel shell, which is provided with an acid-resisting coating at least on its inside surface, the tube sheets consist of plastic material, the circular cylindrical collecting electrodes are fixed by welding in the upper tube sheet, and the entire free space which is available between the tube sheets outside the collecting electrodes is filled with foamed plastic material as far as to the inside surface of the housing The foam consists preferably of a polyurethane foam which in a fully expanded state has a compression of 5 to 10% and a compressive strength of 2 to 6 kp/cm$^2$.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
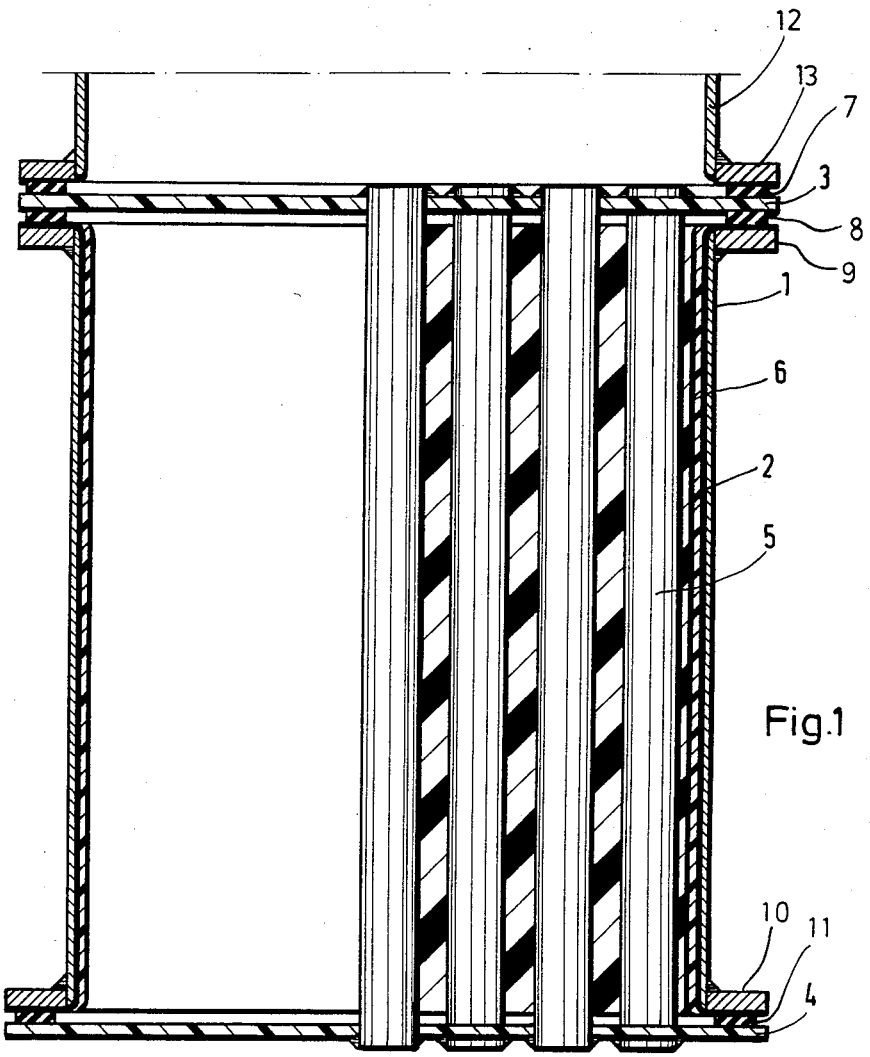
FIG. 1 is an axial section through the bank of collecting tubes or the middle part of the electrostatic precipitator.
Figure 2:
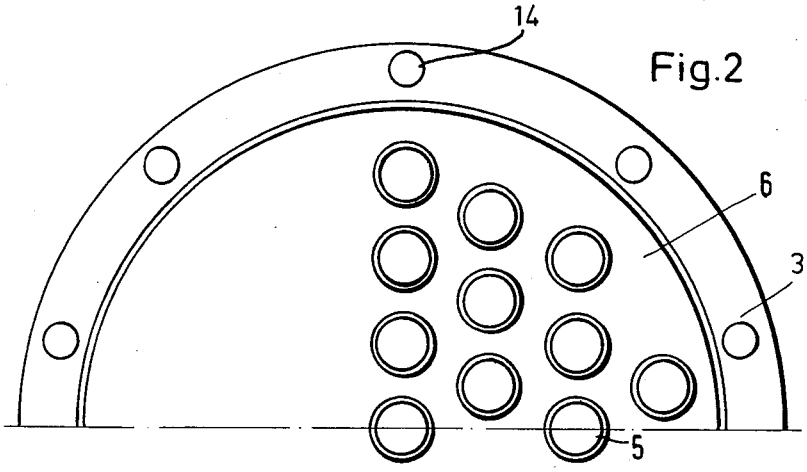
FIG. 2 is a fragmentary plan view of this part showing the upper tube sheet from above.

In accordance with FIG. 1 the middle portion of a tubular electrostatic precipitator comprises a cylindrical housing 1, to which top and bottom flanges have been joined by welding. These parts consist of steel and are provided on their inside surface with an acid-resisting coating 2 (e.g. of nylon or polyethylene). A bank of circular cylindrical collecting electrodes 5 made cf plastic material is disposed in the housing 1 and is held together in known manner by tube sheets 3, 4, which consist also of plastic material (e.g. a nylon-type polyamide or polycarbonate). The circular cylindrical collecting electrodes 5 (e.g. of polyvinylchloride-PVC)are fixed in the upper and lower tube sheets 3, 4 by welding. The entire free space between the tube sheets 3, 4 outside the collecting electrodes 5 and as far as to the inside surface of the housing 1 is filled with plastic foam 6.

The plastic foam 6 is preferably a polyurethane foam which, in a fully expanded state, within the confines of the middle part between the steel shell and the synthetic resin tube sheets and including the tubes 5 has a compression of 5 to 10% and a compressive strength of 2 to 6 kp per $cm^2$. The tube sheets 3 and 4 can be sealed with respect to the flanges 9 and 10 welded to the opposite ends of the steel shell, by sealing rings 8 and 11, respectively, and the middle part shown in FIG. 1 can be connected by flange junctions to upper and lower parts of which only the upper part has been shown at 12. These parts also have flanges 13 which bear against annular seals 7 resting in turn against the respective tube sheets. Bolts passing through holes 14 of the flanges can serve to clamp the tube sheets in place and to hold the middle part in the electrostatic precipitator.

Because the circular cylindrical collecting electrodes 5 are firmly connected to the tube sheets 3, 4 and because the plastic foam is provided, the unit is compact and inherently stable and can take up the weight of the bank of tubes in a much more favorable manner than the conventional structures. For this reason there is no need for a reinforcement of the upper tube sheet by steel beams or the like and the upper tube sheet may be made entirely of plastic material so that the corrosion problems described hereinbefore can no longer occur in that region. The housing can now be made of steel so that the bank of tubes is supported in a satisfactory manner via the upper tube sheet and the weight of the other part can also be taken up in a satisfactory manner. It will be sufficient to provide a corrosion-resisting coating on the inside surface of the housing because even in the case of damage to the collecting electrodes the foam will prevent a seepage of aggressive fluids in appreciably quantities as far as to the housing wall It is apparent that all above-mentioned difficulties which otherwise arise in electrostatic precipitators of the present kind are avoided and the collecting electrodes may consist of standardized plastic tubes, which are much less expensive than the known special shapes. Compared to said special shapes the tubes afford the further advantage that the precipitating field is perfectly symmetrical; this offsets the fact that more space is required than with hexagonal tubes.

We claim:

1. In a tubular electrostatic precipitator, a collecting-tube assembly forming a middle part thereof and comprising:

a cylindrical steel shell formed internally with an acid-resisting coating and defining a housing;

a pair of tube sheets of synthetic resin material disposed at opposite ends of said shell;

a multiplicity of spaced-apart plastic collecting tubes defining collecting electrodes positioned in and welded to said tube sheets; and a body of foamed synthetic resin material filling said housing between said tube sheets and around said collecting tubes.

2. The tubular electrostatic precipitator defined in claim 1 wherein said foamed synthetic resin material is a polyurethane foam.

3. The tubular electrostatic precipitator defined in claim 2 wherein said foam has a compression of 5 to 10% and a compressive strength of 2 to 6 kp per $cm^2$.

* * * * *